US009908741B2

(12) United States Patent
Rodriguez et al.

(10) Patent No.: US 9,908,741 B2
(45) Date of Patent: Mar. 6, 2018

(54) CORD STORAGE DEVICE

(71) Applicants: Diana Rodriguez, Fort Worth, TX (US); Monique Cote, Fort Worth, TX (US); Teresa M. Lawlor, Fort Worth, TX (US); Jose R. Rodriguez, Jr., Saginaw, TX (US); Carol A. Rodriguez, Saginaw, TX (US)

(72) Inventors: Diana Rodriguez, Fort Worth, TX (US); Monique Cote, Fort Worth, TX (US); Teresa M. Lawlor, Fort Worth, TX (US); Jose R. Rodriguez, Jr., Saginaw, TX (US); Carol A. Rodriguez, Saginaw, TX (US)

( * ) Notice: Subject to any disclaimer, the term of this patent is extended or adjusted under 35 U.S.C. 154(b) by 274 days.

(21) Appl. No.: 14/594,342

(22) Filed: Jan. 12, 2015

(65) Prior Publication Data

US 2016/0204560 A1 Jul. 14, 2016

Related U.S. Application Data

(60) Provisional application No. 61/979,790, filed on Apr. 15, 2014.

(51) Int. Cl.

| | |
|---|---|
| ***B65H 75/12*** | (2006.01) |
| ***B65H 75/28*** | (2006.01) |
| ***H01R 13/72*** | (2006.01) |
| ***B65H 75/44*** | (2006.01) |

(52) U.S. Cl.

CPC ..... *B65H 75/12* (2013.01); *B65H 75/28* (2013.01); *B65H 75/4473* (2013.01); *H01R 13/72* (2013.01); *B65H 2701/34* (2013.01); *B65H 2701/3919* (2013.01)

(58) Field of Classification Search

CPC ..... B65H 75/12; B65H 75/25; B65H 75/4473

See application file for complete search history.

(56) References Cited

U.S. PATENT DOCUMENTS

| | | | | |
|---|---|---|---|---|
| 4,802,638 | A * | 2/1989 | Burger | B65H 75/143 242/388.1 |
| 7,651,047 | B2 | 1/2010 | Peng et al. | |
| 8,292,656 | B2 | 10/2012 | Mydlarz | |
| 8,523,098 | B2 | 9/2013 | Detweiler | |
| D692,293 | S | 10/2013 | Toscani et al. | |
| 2003/0038209 | A1* | 2/2003 | Remeczky | B65H 75/143 242/610.6 |
| 2011/0095119 | A1* | 4/2011 | Thorn | B65H 75/143 242/388.1 |

* cited by examiner

*Primary Examiner* — Sang Kim

(74) *Attorney, Agent, or Firm* — Geoffrey A. Mantooth; Brian K. Yost

(57) ABSTRACT

A cord storage device has a base member with two sides, and a plug receptacle extending from one side. The plug receptacle anchors a plug end of an electronic device cord and forms a core about which the cord can be wound. A flexible retaining wall is coupled to the base member and moves between a closed position on the one side and an open position on the other side of the base member. In the closed position, an annular space is formed for the wound cord.

10 Claims, 12 Drawing Sheets

CORD STORAGE DEVICE

This application claims the benefit of U.S. provisional patent application No. 61/979,790, filed Apr. 15, 2014.

FIELD OF THE INVENTION

The present invention relates to devices for storing cords and their associated plugs or appliances, such as charger cords for electrical and electronic devices.

BACKGROUND OF THE INVENTION

Mobile electronic devices such as cellular telephones, music players and cameras have proliferated among consumers. Many of these devices have rechargeable batteries. To recharge the batteries, the device is plugged into a power source such as an electrical outlet or a home device such as a personal computer. The plugging in occurs by way of a charging cord.

Cellular telephones and music players may be used with head phones. Head phones are attached to the electronic device by way of one or more cords.

These cords, when not in use, may be stored in a purse, briefcase, etc. where they can become easily tangled with other items. When used the next time, the cords must necessarily be untangled.

What is needed is a device for storing the cord in a simple, convenient and low cost manner.

SUMMARY OF THE INVENTION

A cord storage device comprises a base member having a first side and an opposite second side. A plug receptacle extends from the first side of the base member. The plug receptacle receives a plug end of an electronic device cord. The plug receptacle forms a core about which the remainder of the cord can be wound. A flexible retaining wall is coupled to the base member. The retaining wall is movable between first and second positions. When the flexible wall is in the first position, the flexible wall is on the first side of the base member and creates an annular space for receiving the wound cord, which annular space is between the retaining wall and the plug receptacle. When the flexible wall is in the second position, the flexible wall is on the second side of the base member and allows the cord to be wound about the plug receptacle or unwound from the plug receptacle.

In accordance with one aspect, when the retaining wall is in the first position, the retaining wall has a first diameter where the retaining wall is coupled to the base member. The retaining wall has an open end such that the annular space is between the open end of the retaining wall and the base member. The retaining wall has a second diameter at the open end. The retaining wall has a third diameter at a location between the open end and the base member. The third diameter being greater than either of the first and second diameters.

In accordance with another aspect, the plug receptacle has a free end. The plug receptacle free end does not protrude beyond the open end of the retaining wall when the retaining wall is in the first position.

In accordance with another aspect, the base member is flat on the first and second sides.

In accordance with another aspect, the retaining wall is coupled to the base member by a living hinge.

In accordance with another aspect, the base member further comprises a rigid plate. Flexible material is located on the first and second sides of the rigid plate. The flexible material is coupled to the flexible retaining wall.

In accordance with another aspect, the plug receptacle comprises an upside down "U" shape projecting from the base member first side.

In accordance with another aspect, the upside down "U" shaped projection is a first projection. The plug receptacle further comprises a second projection laterally spaced along the base member from the first projection so as to form a gap between the first and second projections.

In accordance with another aspect, the plug receptacle comprises a wall projecting from the base member first side. The wall has a notch therein. The wall forms an interior cavity for receiving an end of the cord.

In accordance with another aspect, the plug receptacle has an interior cavity that provides an interference fit with at least one end of the cord.

DESCRIPTION OF THE PREFERRED EMBODIMENT

Figure 1:
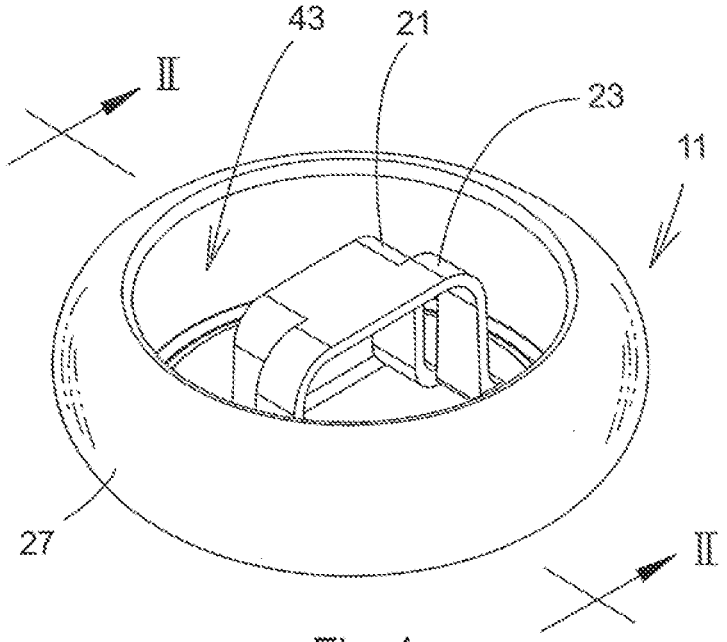
FIG. 1, is a perspective view of the device, shown with the retaining wall in the closed position.

The device 11 is pooch-like and capable of storing cords 13 and associated plugs 15, 17, 19 (FIGS. 8-12). Storage is easy and involves anchoring an end of the cord, followed by wrapping the cord around, a center. Once the cord is stored, the pouch is closed to prevent the cord from unwinding and becoming tangled with other objects. The pouch can be easily opened to retrieve the cord.

The device 11 stores several types and sizes of plugs as well. As used herein "plugs" includes the termination or end of a cord, which cord is used with an electronic device. Plugs include a plug for an electrical wall socket, a USB plug, a jack, and any proprietary plugs, etc.

The device 11 is shown in FIGS. 1-7 and includes one or more plug receptacles 21, 23, a base 25 and a retaining wall 27. In the description herein, like reference numbers indicate like components between embodiments.

There is a primary, or center, plug receptacle 21 and one or more secondary plug receptacles 23. The plug receptacles 21, 23 are mounted to the base 25. The primary plug receptacle 21 is an upside down "U" shaped wall coupled to the base 25. The primary plug receptacle 21 has an upper wall portion 31 and side wall portions 33. The receptacle 21 has an inside width and height that is close to the width and height of the respective plug 19, so as to form an interference fit with the plug 19. The primary plug receptacle has a longitudinal axis that is the axis along which the plug 19 is inserted into and removed from the receptacle 21.

The secondary plug receptacle 23 is formed from an upside down "U" shaped wall coupled to the base. The secondary plug receptacle 23 has an upper wall portion 35 and side wall portions 37. The secondary plug receptacle is adjacent to and located along the longitudinal axis of the first plug receptacle such that the two upper wall portions 31, 35 are coupled together and coplanar. Thus, the height of the secondary plug receptacle is the same as the height of the primary plug receptacle. However, the secondary plug receptacle has a larger width between the side wall portions 37 than does the primary plug receptacle. The side wall portions 37 are spaced apart from the side wall portions 33 of the primary plug receptacle so as to form a gap 38 there between. In the preferred embodiment, there are two gaps 38, one on either side of the primary plug receptacle 21.

Figure 2:
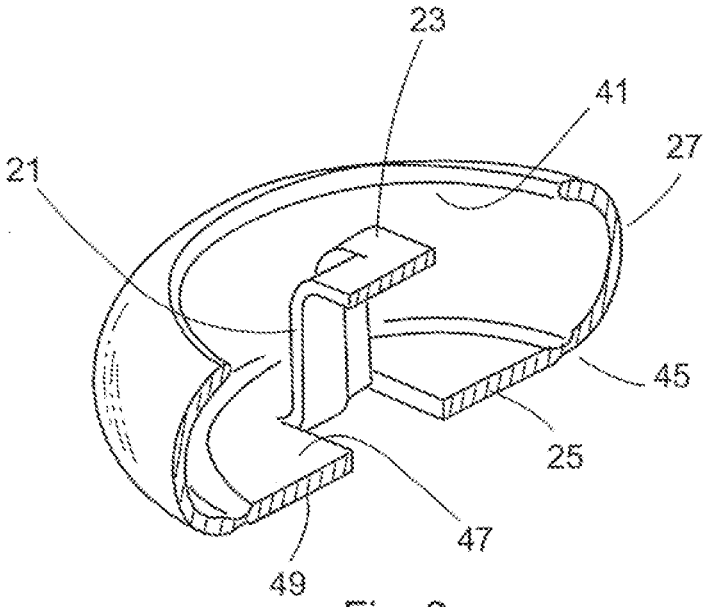
FIG. 2 is a cross-sectional view of the device, taken through lines II-II of FIG. 1.
Figure 7:
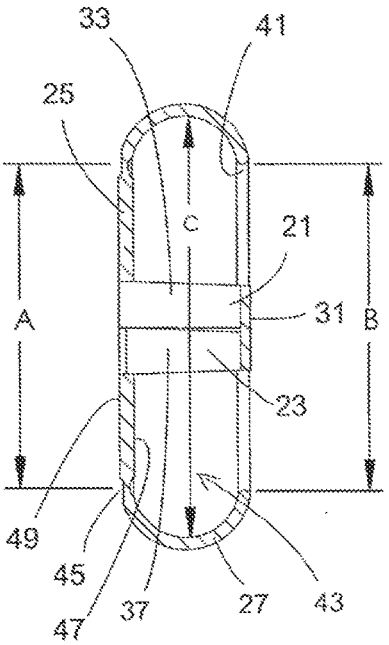
FIG. 7 is a cross-sectional view of the device taken through lines VII-VII of FIG. 4.
Figure 5:
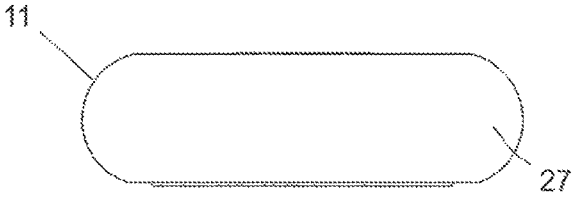
FIG. 5 is a side view of the device.
Figure 6:
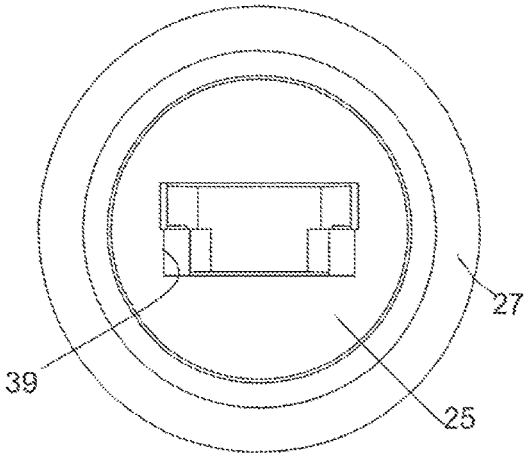
FIG. 6 is a bottom view of the device.

The base 25 forms a generally flat disc, having first and second sides 47, 49 (see FIGS. 2 and 7). The base 25 may have an opening 39 underneath the two plug receptacles, as shown in the figures. Alternatively, the base can be solid underneath the receptacles. The base 25 is generally circular when viewed in a plan view. The receptacles 21, 23 are located on one side 47 of the base and extend out from that side. The other side of the base is flat so that the device 11 can rest on a flat surface.

The retaining wall 27 is coupled to the outer periphery of the base 25. The retaining wall 27 can be positioned in the closed position (see FIGS. 1-2, 4-7 and 12) or an open position (see FIGS. 3, 8-11). In the closed position, the retaining wall forms the outer portion of a toroid, with the base closing off one side and the other side being open, and the center occupied by the plug receptacles 21, 23. Thus, the retaining wall, when viewed in the cross-section 21 orientation as shown in FIG. 7, curves out, then up and back in, in a sideways "C" shape. The retaining wall has a first diameter "A" (see FIG. 7) at the base, a second diameter "B" at its opening or free edge 41 and an inside diameter "C" which is midway between the first and second diameters A, B. The first and second diameters A, B are smaller than the inside diameter C. In the preferred embodiment, the first and second diameters A, B are substantially the same to each other, although one could be made larger than the other. An annular space 43 is formed between the retaining wall 27 and the receptacles 21, 23. The cord is wound around the receptacles and is located in this annular space 43.

Figure 3:
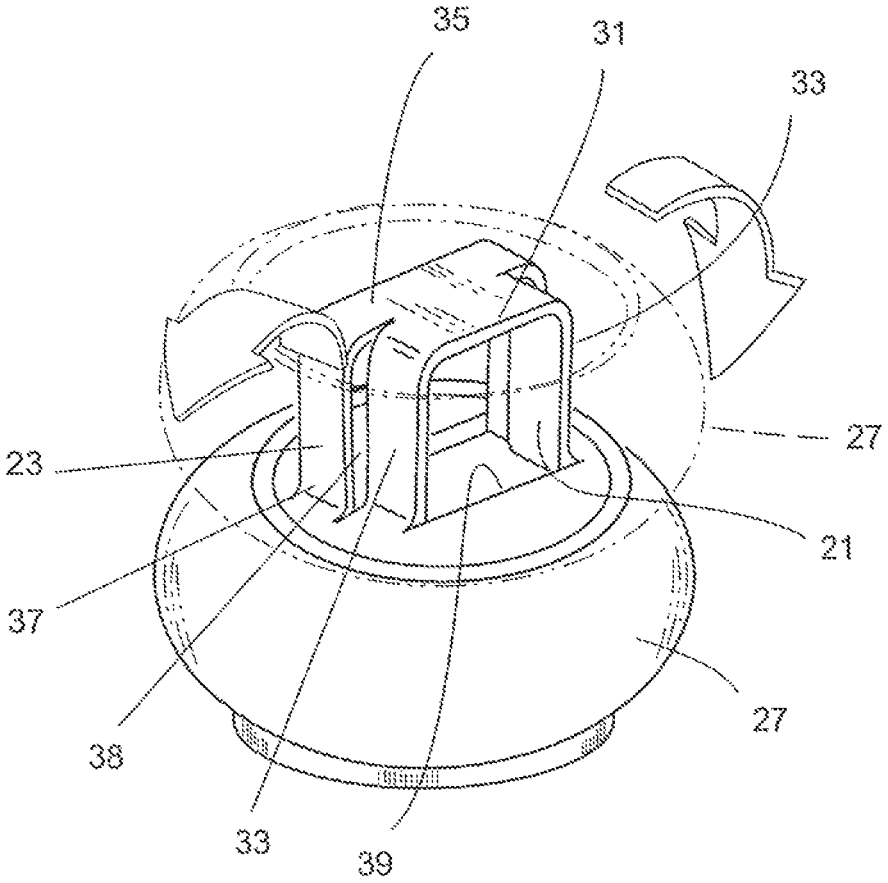
FIG. 3 is a perspective view of the device shown with the retaining wall in the open position.
Figure 4:
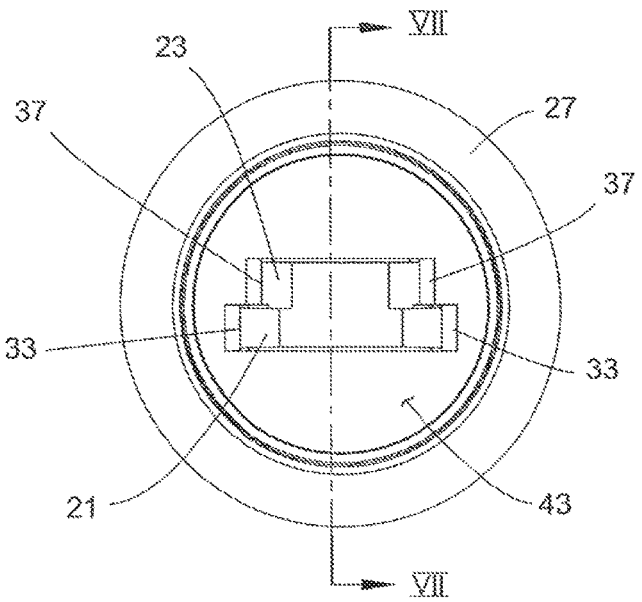
FIG. 4 is a top plan view of the device.

When in the open position, the retaining wall 27 also forms a toroid, but with the receptacles 21, 23 now located outside of the toroid, as shown in FIG. 3. Thus, the receptacles 21, 23 are exposed.

When, in the closed position, the upper wall portions 31, 35 of the receptacles 21, 23 are either coplanar with the inner edge 41 of the retaining wall, or located inside of the toroid. This allows the device to rest either on the base, or on the free edge 41 side of the device, when the device is placed on a flat surface.

The device 11 is made of a flexible material such as thermoplastic-rubber, or a thermoplastic elastomer (TPE). TPE is in a class of styrenic block copolymers, polyolefin blends and elastomeric alloys. The device 11 can be injection molded so as to be low in cost.

The use of such a material allows the receptacles 21, 23 to be flexible in receiving and releasing the plugs and allows the retaining wall 27 to be flexible in moving between the open and closed positions. To change position of the retaining wall 27, a user pushes or pulls the retaining wall from one position to the other. For example, to close the retaining wall, the user can locate thumbs on the receptacles or the base, and gripping the edge 41 of the open retaining wall with fingers, pulls the retaining wall into the closed position. Once the wall is moved into a particular position, the retaining wall 27 is stable and remains in that position until forced out of it In the preferred embodiment, to ease the movement of the retaining wall 27 between positions, the wall thickness is reduced where the retaining wall joins the base. This creates a living hinge 45.

The cord 13 is typical, having a length and two ends. Each end has a plug or some appliance. Although a recharging cord for an electronic device is shown, the device can be used, with other types of cords, such as earphones or earpieces. The cord has two plugs 15, 17. In the embodiment shown, one plug is designed to plug into an electronic device which is to be recharged while the other plug, is designed to plug into a home device or power supply such as a personal computer. In addition, an auxiliary plug, or a primary plug 19 is provided for recharging the device from an electrical ac wall outlet.

Figure 8:
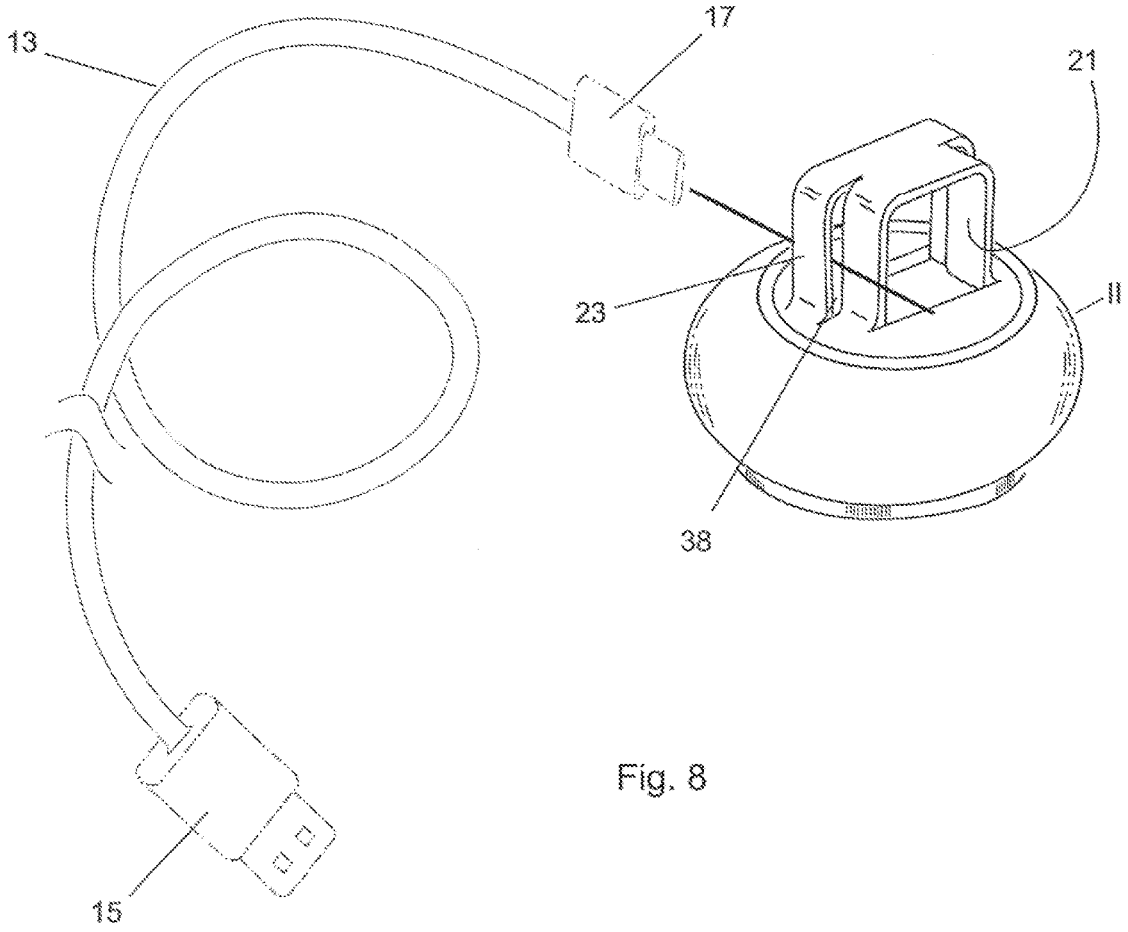
FIGS. 8-12 illustrate the steps in using the device with a cord and one or more plugs.
Figure 9:
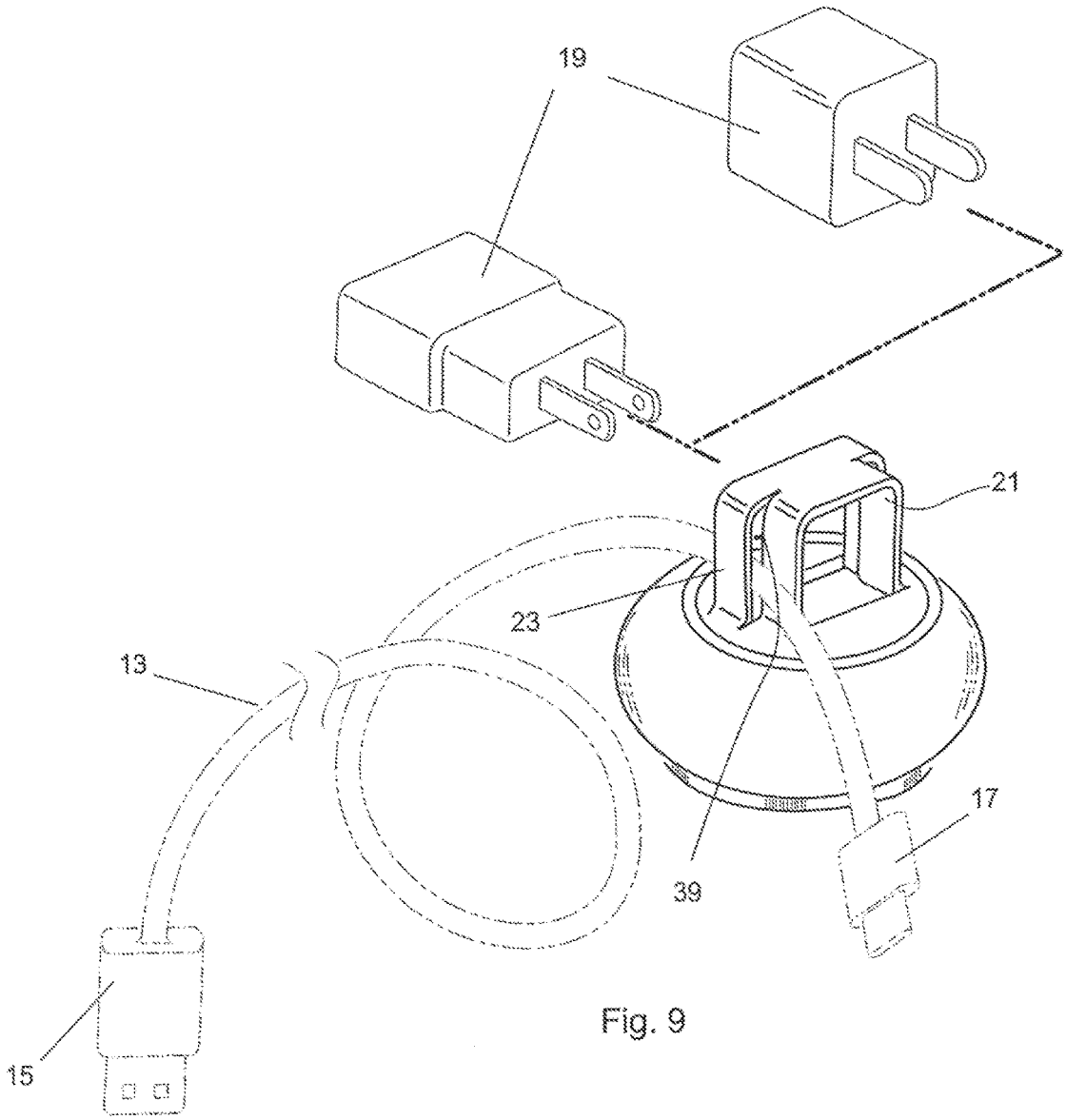
Figure 10:
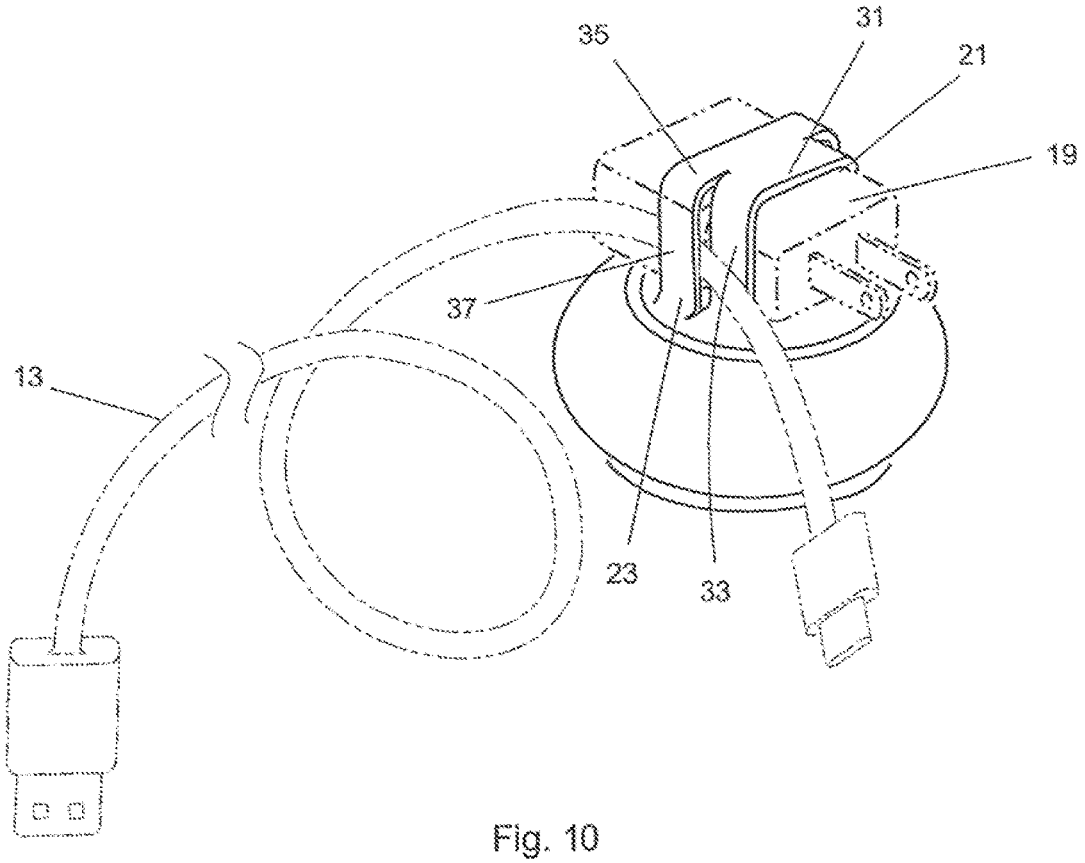
Figure 11:
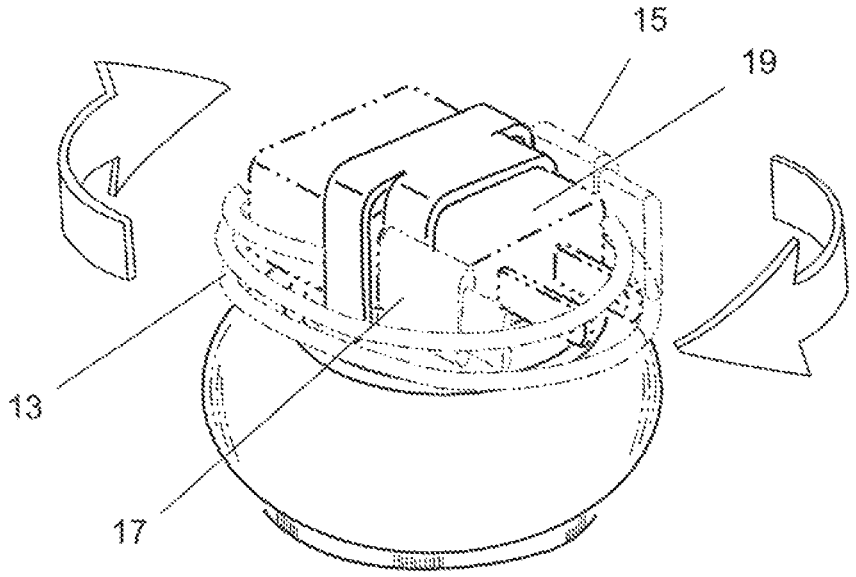
Figure 12:
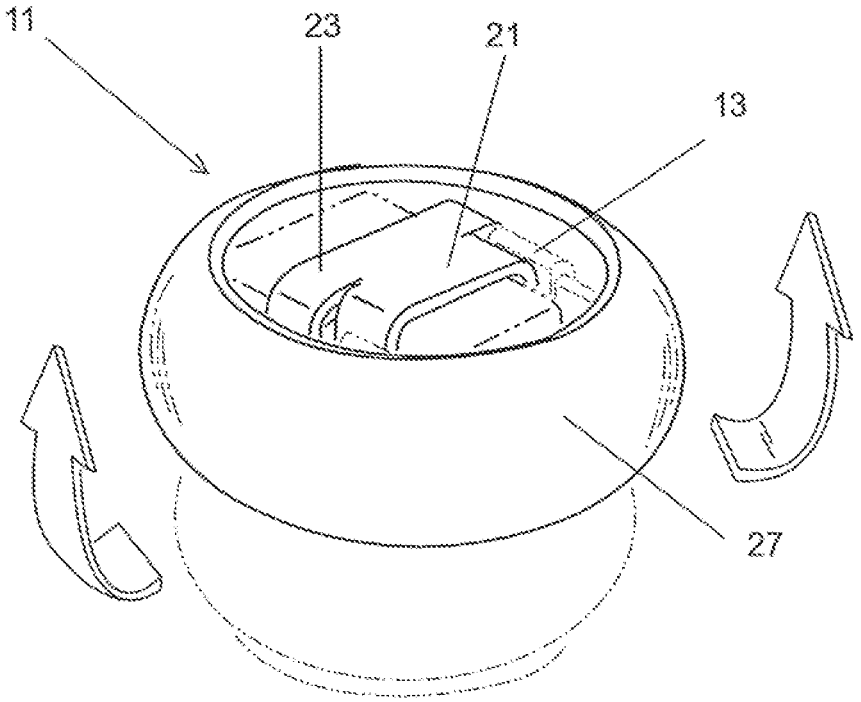

To use, the device 11 is placed in the open position, as shown in FIG. 8, thereby exposing the receptacles 21, 23, and one of the plugs 15, 17 on the cord end is inserted into one of the secondary plug receptacles 23. The side wall portions 33, 37, are pushed apart to allow the plug to be inserted into the respective gap 38. Once the plug is inserted, the gap between the side wall portions shrinks to make it difficult to accidently pull the plug out. Next, the large plug 19 is inserted into the primary plug receptacle 21. The interference fit between the primary plug receptacle and the plug 19 secures the plug in place without slipping (see FIGS. 9 and 10). Next, the cord is wrapped around the center which is formed by the receptacles 21, 23, as shown in FIG. 11. Finally, the retaining wall 27 is moved to the closed position as shown in FIG. 12. The retaining wall maintains the cord in its wound position. The free end 15 of the cord need not be tucked into the remaining portions of the cord but is merely located adjacent to the coil. The retaining wall prevents the cord from unwinding and the plugs from moving out of their respective receptacles. Once closed, the device can be placed on a tabletop, desktop, countertop, or located in a container such as a purse, briefcase, etc.

To use the cord, the procedure described above is reversed. Note that the cord need not be entirely removed from the device during recharging. For example, the cord can be used in the configuration shown in FIG. 9, where the secondary plug receptacle is used to receive a portion of the cord.

The storage device 51 (see FIGS. 13-15) holds other types of cords 53 as well. For example, cord 53 has headphones 55 that allow a user to listen to music, voice, etc. from an electronic device. In addition, the cord may contain a microphone (not shown) to allow the user to speak or talk to the electronic device. The cord 53 has one end terminating in a jack 57, which jack is inserted into an appropriate port in the electronic device. The other end of the cord may be split into two cord ends, with a headphone or earphone 55 on each end.

Figure 13:
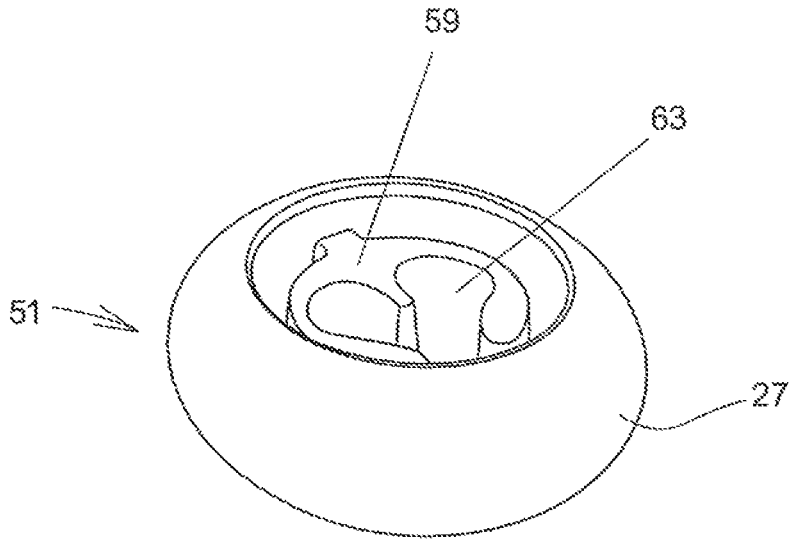
FIG. 13 is a perspective view of the device in accordance with another embodiment, as shown with the retaining wall in the closed position.
Figure 14:
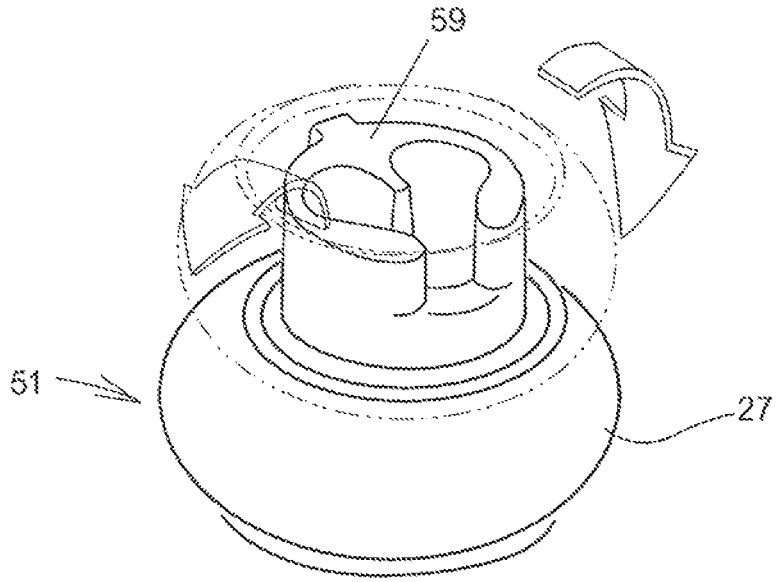
FIG. 14 is a perspective view of the device of FIG. 13, shown with the retaining wall in the open position.
Figure 15:
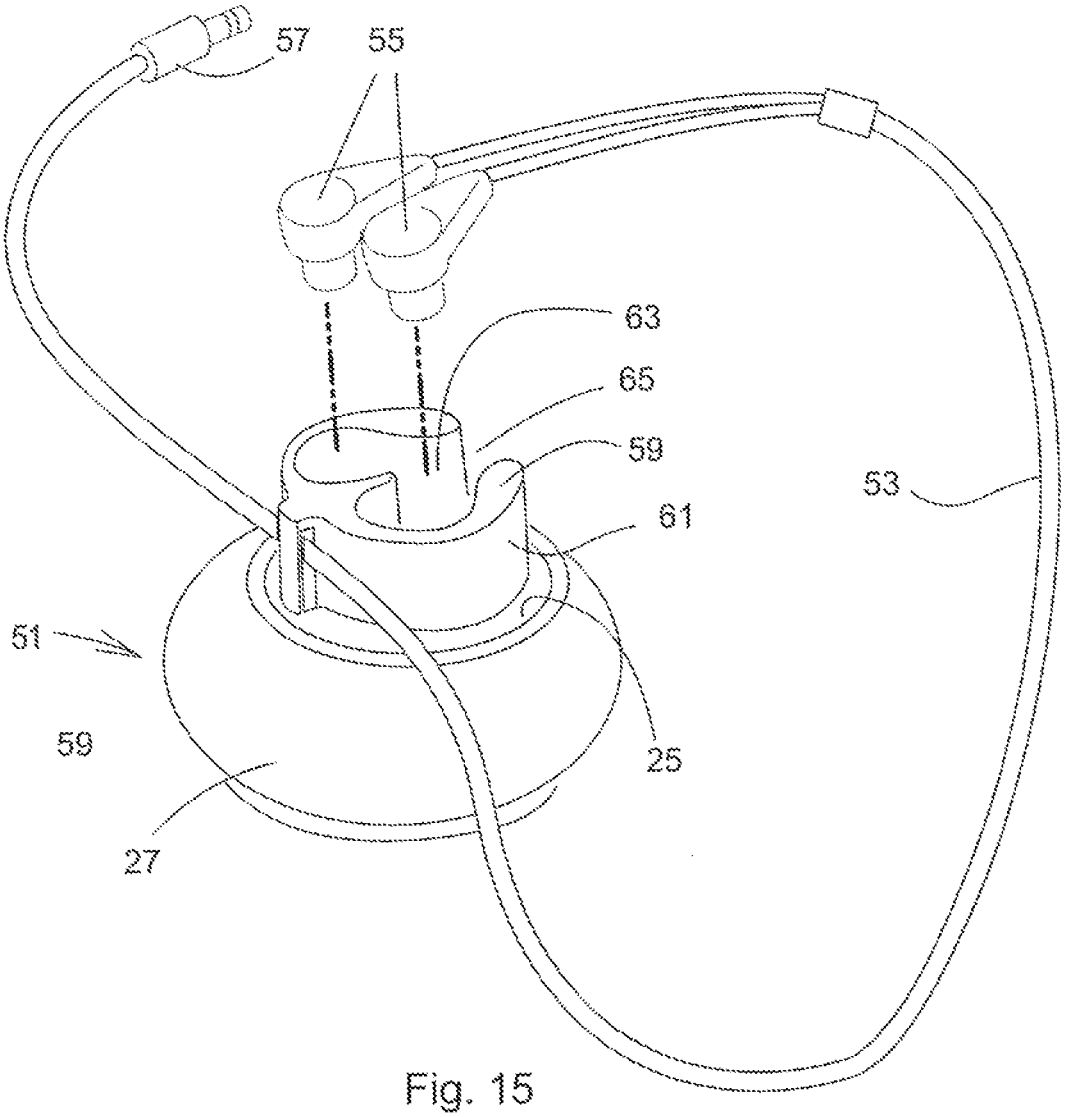
FIG. 15 is a perspective view of the device of FIG. 14, shown with a set of earphones being located therein for storage.

FIGS. 13-15 show the storage of the headphone cord 53 in the device 51, in accordance with another embodiment. The device 51 is the same as the device 11 shown in FIGS. 1-12, with the exception of the plug receptacle 59. The plug receptacle 59 is modified to retain the earphones 55. The plug receptacle has a generally cylindrical wall 61 extending out from the base first side 47 and perpendicular to the base. The wall 61 encompasses an interior cavity 63. The wall 61 has a gap 65 leading to the interior cavity 63. The interior cavity 63 is shown as conforming to the shape of the earphones 55 and providing an interference fit between the cavity and the earphones. Alternatively, the interior cavity 63 can be cylindrical or some other shape and the plug end or headphones need not be secured by an interference fit inside the plug receptacle. Opposite the gap 65 on the outside of the wall 61 is a standoff wall 67. The standoff wall 67 is separated from the cylindrical wall by gap 69, which gap receives a portion of the cord 53. The cylindrical wall and standoff wall are flexible to allow the gap 69 to be enlarged so as to receive the plug 57 and to close against the cord.

To use, the retaining wall is moved from the closed position (see FIG. 13) to the open position (see FIG. 14) to expose the plug receptacle. The earphones 55 are inserted into the plug receptacle cavity 63 with the cord extending in the gap 65. The other end of the cord is inserted through the gap 69. Then, the remainder of the cord is wrapped around the plug receptacle, after which the retaining wall 27 is moved to the closed position, thereby securing the cord in place.

Figure 16:
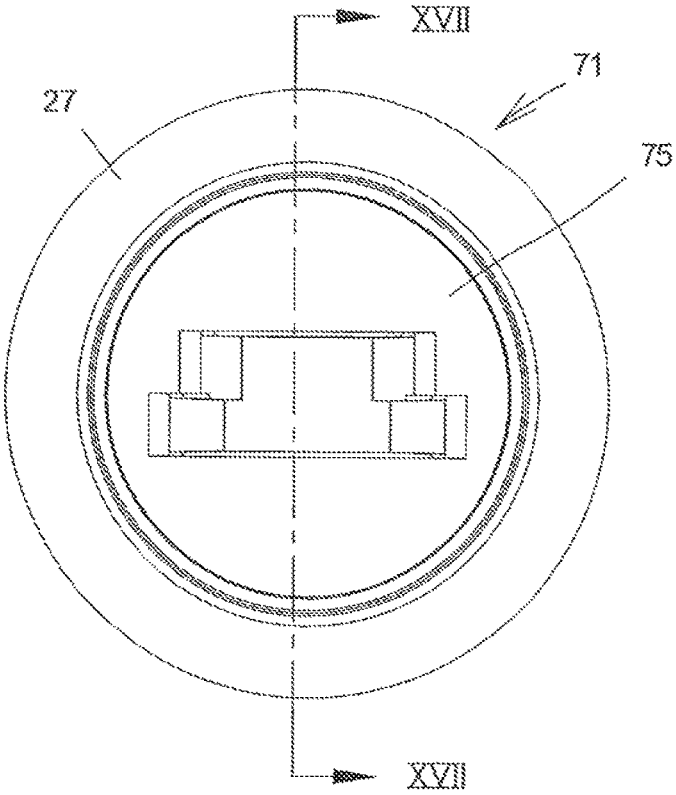
FIG. 16 is a top plan view of the device in accordance with another embodiment.
Figure 17:
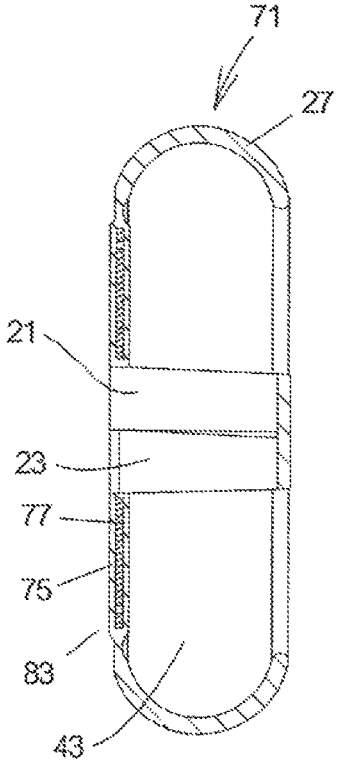
FIG. 17 is a cross-sectional view of the device, taken through lines XVII-XVII of FIG. 16.
Figure 18:
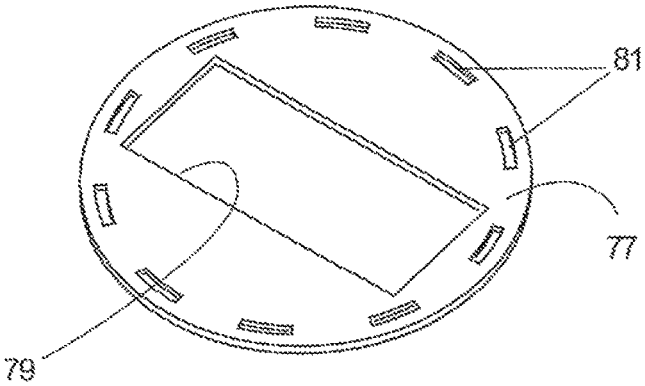
FIG. 18 is a perspective view of a rigid base plate used in the embodiment of FIGS. 16 and 17.

FIGS. 16-18 show the storage device 71 in accordance with another embodiment. The storage device is substantially the same as the storage device 11, except that the base 75 is stiff. The base 75 has a stiff base member 77 (see FIG. 18) located therein. The base member 77 is a circular, flat plate having a rectangular central opening 79 therethrough and slots 81 around the outer periphery portion.

The base member 77 is inserted into an injection mold and the storage device is over molded onto the base member. The base member 77 is coated on both sides with the flexible material 83, which flexible material is also located in the slots 81 to provide retention of the base member therein. The flexible material 83 also forms the plug receptacles 21, 23 and the retaining wall 27. With this particular embodiment, a living hinge need not be provided where the retaining wall couples to the base.

Figure 19:
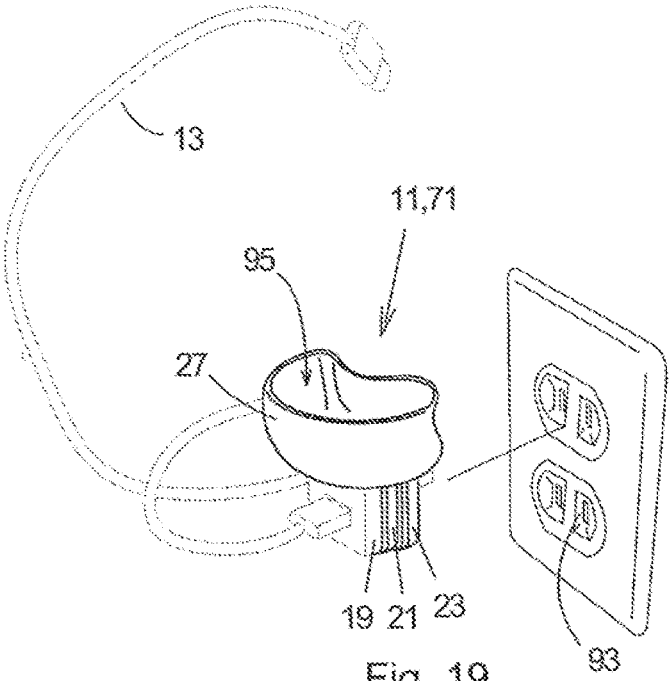
FIG. 19 is a perspective view of the device having a charging plug and cord located therein, which cord is about to be plugged into a wall receptacle.
Figure 20:
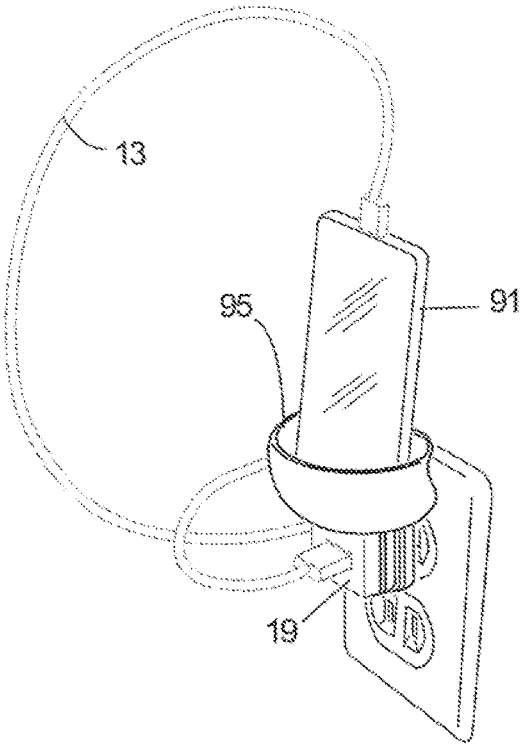
FIG. 20 is a perspective view of the device, showing that the plug plugged into the wall receptacle and holding an electronic device during recharging.

FIGS. 19 and 20 show the storage device 11, 71, in use charging an electronic device 91. The storage device is equipped with a plug 19. The plug 19 is retained in the plug receptacle 21. The cord 13 is unwound, at least partially or fully, with the other end being plugged in to the electronic device 91. The cord 19 is plugged into the wall receptacle 93 so as to charge the electronic device 91. While the electronic device 91 is being charged, it can be located inside of the storage device. When the retaining wall 27 is in the open position, it forms a bowl or a cup 95. This bowl is oriented in the up position as shown in FIGS. 19 and 20. The electronic device 91 is placed into the bowl 95. The retaining wall 27 is flexible so that the portion that is against the wall receptacle flattens. The electronic device may need to be leaned on the wall.

Although the device has been described as storing one cord, plural cords can be stored as well.

The foregoing disclosure and showings made in the drawings are merely illustrative of the principles of this invention and are not to be interpreted in a limiting sense.

The invention claimed is:

1. A cord storage device, comprising:

a) a base member having a first side and an opposite second side;

b) a plug receptacle extending from the first side of the base member, the plug receptacle receives a plug end of an electronic device cord, the plug receptacle forming a core about which the cord can be wound;

c) a retaining wall coupled to the base member, the retaining wall being flexible, the retaining wall movable between first and second positions, wherein when the retaining wall is in the first position, the retaining wall is on the first side of the base member and creates an annular space for receiving the wound cord between the retaining wall and the plug receptacle, and when the retaining wall is in the second position, the retaining wall is on the second side of the base member and allows the cord to be wound about the plug receptacle or unwound from the plug receptacle.

2. The cord storage device of claim 1, wherein when the retaining wall is in the first position, the retaining wall has a first diameter where the retaining wall is coupled to the base member, the retaining wall has an open end such that the annular space is between the open end of the retaining wall and the base member, the retaining wall having a second diameter at the open end, the retaining wall has a third diameter at a location between the open end and the base member, the third diameter being greater than either of the first and second diameters.

3. The cord storage device of claim 2, wherein the plug receptacle has a free end, the plug receptacle free end not protruding beyond the open end of the retaining wall when the retaining wall is in the first position.

4. The cord storage device of claim 3, wherein the base member is flat on the first and second sides.

5. The cord storage device of claim 1, further comprising a living hinge where the retaining wall is coupled to the base member.

6. The cord storage device of claim 1, wherein the base member further comprises a rigid plate, with flexible material located on the first and second sides of the rigid plate, the flexible material is coupled to the retaining wall.

7. The cord storage device of claim 1, wherein the plug receptacle comprises an upside down "U" shape projecting from the base member first side.

8. The cord storage device of claim 7, wherein the upside down "U" shaped projection is a first projection, the plug receptacle further comprising a second projection laterally spaced along the base member from the first projection so as to form a gap between the first and second projections.

9. The cord storage device of claim 1, wherein the plug receptacle comprises a wall projecting from the base member first side, the wall having a notch therein, the wall forming an interior cavity for receiving an end of the cord.

10. The cord storage device of claim 1, wherein the plug receptacle has an interior cavity that provides an interference fit with at least one end of the cord.

* * * * *